US006547849B2

(12) United States Patent
Gross et al.

(10) Patent No.: US 6,547,849 B2
(45) Date of Patent: Apr. 15, 2003

(54) LADLE REFINING OF STEEL

(75) Inventors: Clay Gross, Ladoga, IN (US); Rama Ballav Mahapatra, Indianapolis, IN (US); Walter W. Blejde, Brownsburg, IN (US); Steve Leonard Wigman, Brownsburg, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 10/114,627

(22) Filed: Apr. 2, 2002

(65) Prior Publication Data

US 2002/0174746 A1 Nov. 28, 2002

Related U.S. Application Data

(60) Provisional application No. 60/280,916, filed on Apr. 2, 2001.

(51) Int. Cl.[7] ..... C21C 7/064
(52) U.S. Cl. ..... 75/548; 75/558; 75/570
(58) Field of Search ..... 75/558, 548, 570

(56) References Cited

U.S. PATENT DOCUMENTS

| | | | | |
|---|---|---|---|---|
| 3,885,957 A | | 5/1975 | Richter et al. | |
| 4,695,318 A | * | 9/1987 | Knauss et al. | 75/309 |
| 4,999,053 A | * | 3/1991 | Ototani et al. | 420/129 |
| 5,518,518 A | * | 5/1996 | Blum et al. | 148/304 |

FOREIGN PATENT DOCUMENTS

| | | | | |
|---|---|---|---|---|
| JP | 5 9006-315 | | 1/1984 | |
| JP | 0 1255-616 | | 10/1989 | |
| JP | 7316637 | | 12/1995 | |
| JP | 8109411 | | 4/1996 | |
| JP | 08176661 | * | 7/1996 | C21D/8/02 |
| JP | 8246030 | | 9/1996 | |
| JP | 09-217110 | | 8/1997 | |
| JP | 10212514 | | 8/1998 | |
| JP | 2000160233 | * | 6/2000 | C21C/7/10 |
| JP | 2000234119 A | * | 8/2000 | C21C/7/064 |
| SU | 446-554 | | 10/1974 | |
| SU | 438-717 | | 1/1975 | |
| SU | 487-138 | | 12/1975 | |
| SU | 532-630 | | 12/1976 | |
| SU | 1323-579 | | 7/1987 | |
| SU | 1802821 | | 3/1993 | |

OTHER PUBLICATIONS

Unit Conversion Chart for gases, http://user.chollian.net~kiam4904/chart.html.*

* cited by examiner

*Primary Examiner*—Roy King
*Assistant Examiner*—Tima McGuthry-Banks
(74) *Attorney, Agent, or Firm*—Barnes & Thornburg

(57) ABSTRACT

A steel charge and slag forming material is heated in a ladle to form molten steel covered by a slag containing silicon, manganese and calcium oxides. The steel is stirred by injection of an inert gas such as argon or nitrogen to cause silicon/manganese-deoxidation and desulphurization to produce a silicon/manganese killed molten steel. Stirring of the molten steel by the inert gas injection while in contact with slag high in calcium oxide generates low free oxygen levels in the steel and desulphurization to sulphur levels below 0.009%. The slag may subsequently be thickened by lime addition to prevent reversion of sulphur back into the steel and oxygen may be injected into the steel to increase its free oxygen content to produce a steel that is readily castable in a twin roll caster.

19 Claims, 1 Drawing Sheet

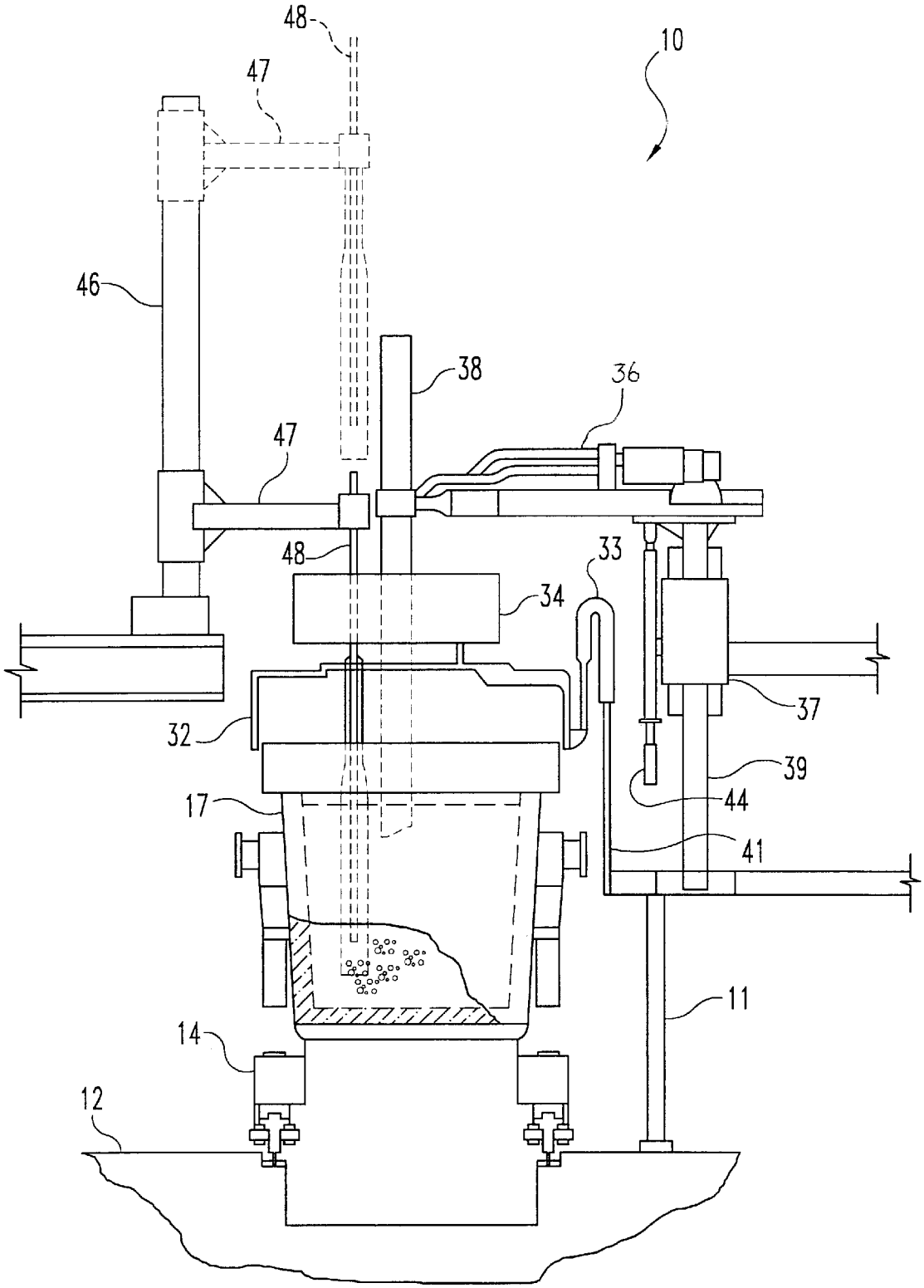
48
47
10
46
38
36
47
48
33
34
37
32
39
44
17
41
11
14
12

LADLE REFINING OF STEEL

This application claims the benefit of U.S. Provisional Patent Application Serial No. 60/280,916, which was filed on Apr. 2, 2001.

BACKGROUND AND SUMMARY OF THE INVENTION

This invention relates to ladle refining of steel. It has particular, but not exclusive, application to the ladle refining of steel to be directly cast into thin steel strip in a continuous strip caster.

It is known to cast metal strip by continuous casting in a twin roll caster. In such a process, molten metal is introduced between a pair of contra-rotated horizontal casting rolls which are cooled so that metal shells solidify on the moving roll surfaces and are brought together at the nip between them to produce a solidified strip product which is delivered downwardly from the nip between the rolls. The molten metal may be introduced into the nip between the rolls via a tundish and a metal delivery nozzle located beneath the tundish so as to receive a flow of metal from the tundish and to direct it into the nip between the rolls, so forming a casting pool of molten metal supported on the casting surfaces of the rolls immediately above the nip. This casting pool may be confined between side plates or dams held in sliding engagement with the ends of the rolls.

Twin roll casting has been applied with some success to non-ferrous metals which solidify rapidly on cooling, for example aluminum. However, there have been problems in applying the technique to the casting of ferrous metals. One particular problem has been the propensity for ferrous metals to produce solid inclusions which clog the very small metal flow passages required in a twin roll caster.

The use of silicon-manganese in ladle deoxidation of steel was practiced in ingot production in the early days of Bessemer steelmaking and as such the equilibrium relations between the reaction product molten manganese silicates and the residual manganese, silicon and oxygen in solution in steel are well known. However in the development of technology for the production of steel strip by slab casting and subsequent cold rolling, silicon/manganese deoxidation has generally been avoided and it has been considered necessary to employ aluminum killed steels. In the production of steel strip by slab casting and subsequent hot rolling followed often by cold rolling, silicon/manganese killed steels produce an unacceptably high incidence of stringers and other defects resulting from a concentration of inclusions in a central layer of the strip product.

In the continuous casting of steel strip in a twin roll caster, it is desirable to generate a finely controlled flow of steel at constant velocity along the length of the casting rolls to achieve sufficiently rapid and even cooling of steel over the casting surfaces of the rolls. This requires that the molten steel be constrained to flow through very small flow passages in refractory materials in the metal delivery system under conditions in which there is a tendency for solid inclusions to separate out and clog those small flow passages.

After an extensive program of strip casting various grades of steel in a continuous strip roll caster we have determined that conventional aluminum killed carbon steels or partially killed steel with an aluminum residual content of 0.01% or greater generally cannot be cast satisfactorily because solid inclusions agglomerate and clog the fine flow passages in the metal delivery system to form defects and discontinuities in the resulting strip product. This problem can be addressed by calcium treatment of the steel to reduce the solid inclusions but this is expensive and needs fine control, adding to the complexity of the process and equipment. On the other hand, it has been found that it is possible to cast strip product without stringers and other defects normally associated with silicon/manganese killed steels because the rapid solidification achieved in a twin roll caster avoids the generation of large inclusions and the twin roll casting process results in the inclusions being evenly distributed throughout the strip rather than being concentrated in a central layer. Moreover, it is possible to adjust the silicon and manganese contents so as to produce liquid deoxidation products at the casting temperature to minimize agglomeration and clogging problems.

In conventional silicon/manganese deoxidation processes, it has not been possible to lower free oxygen levels in the molten steel to the same extent as is achievable with aluminum deoxidation and this in turn has inhibited desulphurization. For continuous strip casting, it is desirable to have a sulphur content of the order of 0.009% or lower. In conventional silicon/manganese deoxidation processes in the ladle, the desulphurization reaction is very slow and it becomes impractical to achieve desulphurization to such low levels particularly in the case where the steel is produced by the electric arc furnace (EAF) route using commercial quality scrap. Such scrap may typically have a sulphur content in the range 0.025% to 0.045% by weight. The present invention enables more effective deoxidation and desulphurization in a silicon/manganese killed steel and refining of high sulphur steel in a silicon/manganese killed regime to produce low sulphur steel suitable for continuous thin strip casting.

According to an illustrative embodiment of the invention there is provided a method of refining steel in a ladle, including heating a steel charge and slag forming material in a ladle to form molten steel covered by a slag containing silicon, manganese and calcium oxides, and stirring the molten steel by injecting an inert gas into it to cause silicon/manganese deoxidation and desulphurization of the steel to produce a silicon/manganese killed molten steel having a sulphur content of less than 0.01% by weight.

The molten steel may have a free oxygen content of no more than 20 ppm during the desulphurization.

The free oxygen content during desulphurization may for example be of the order of 12 ppm or less.

The inert gas may for example be argon.

The inert gas may be injected into a bottom part of the molten steel in the ladle at a rate of between 0.35 scf/min to 1.5 scf/min per ton of steel in the ladle so as to produce a strong stirring action promoting effective contact between the molten steel and the slag.

The inert gas may be injected into the molten steel through an injector in the floor of the ladle and/or through at least one injection lance extended downwardly into the bottom part of the metal in ladle.

The molten steel may have a carbon content in the range 0.001% to 0.1% by weight, a manganese content in the range 0.1% to 2.0% by weight and a silicon content in the range 0.1% to 10% by weight.

The steel may have an aluminum content of the order of 0.01% or less by weight. The aluminum content may for example be as little as 0.008% or less by weight.

The molten steel produced by the method of the present invention may be cast in a continuous thin strip caster into thin steel strip of less than 5 mm thickness.

Heating of the ladle may be carried out in a ladle metallurgical furnace (LMF). The LMF may have several functions, including:

1. Heat the liquid steel in the ladle to the required exit temperature that is suitable for subsequent processing such as a continuous casting operation.
2. Adjust the steel composition to the specific requirements of the following process.
3. Achieve reduction of the sulphur content of the steel to the aim final sulphur content.
4. Achieve thermal and chemical homogeneity in the liquid steel bath.
5. The agglomeration and floatation of oxide inclusions and their subsequent capture and retention in the refining slag.

In a conventional ladle metallurgical furnace (LMF), the heating may be achieved by electric arc heaters. The liquid steel must be covered with a refining slag weight and a gentle forced circulation is required for temperature homogeneity. This is achieved by electromagnetic stirring or gentle argon bubbling. The weight and thickness of the slag is sufficient to enclose the electric arcs, and whose composition and physical characteristics (i.e., fluidity) are such that the slag captures and retains sulphur and solid and liquid oxide inclusions which result from deoxidation reactions and/or reaction with atmospheric oxygen.

The molten steel may be stirred by injection of an inert gas such as for example argon or nitrogen to facilitate slag-metal mixing in the ladle and desulphurization of the steel. Typically, the inert gas may be injected through a permeable refractory purging plug located in the bottom of the ladle or through a lance. We have now determined that if an unusually strong or violent stirring action is achieved, for example by injection of argon through a lance that is dipped into the steel, in conjunction with a slag regime rich in CaO it is possible to achieve remarkable non-equilibrium outcomes such as very low steel free oxygen levels with silicon deoxidation. In particular, it is possible readily to achieve free oxygen levels of the order of 10 ppm as opposed to an expected result of 50 ppm. This low free oxygen content enables more effective desulphurization and it becomes possible to achieve very low sulphur levels in a silicon/manganese killed steel.

Specifically, we have determined that by injecting argon through a lance at flow rates of 0.35 scf/min to 1.5 scf/min per ton of molten steel with a liquid slag high in CaO it is possible to achieve free oxygen in a silicon/manganese regime at 1600° C. of less than 12 ppm and as low as 8 ppm and to rapidly achieve desulphurization to sulphur levels of below 0.009%. It is believed that the violent stirring of the molten metal promotes mixing between the liquid slag and the steel and promotes removal of $SiO_2$, which is the product of the reaction of silicon with free oxygen in the steel, thereby promoting continuation of the silicon deoxidation reaction to produce low free oxygen levels more conventionally expected with aluminum deoxidation.

At the conclusion of the desulphurization step, the slag may be thickened to prevent reversion of sulphur back into the steel, and then oxygen injected into the steel to increase the free oxygen content to between about 40 ppm and about 70 ppm and generally about 50 ppm so as to produce a steel that is readily castable in a twin roll caster.

BRIEF DESCRIPTION OF THE DRAWING

In order that the invention may be more fully explained, an illustrative embodiment of the invention will be described with reference to the accompanying drawing, which is a partly sectioned side-elevation of a ladle metallurgical furnace.

DETAILED DESCRIPTION OF THE DRAWING

In an illustrative embodiment of the invention, a steel charge and slag forming material is heated and refined in a ladle 17 using an LMF 10 to form a molten steel bath covered by a slag. The slag may contain, among other things, silicon, manganese and calcium oxides. Referring to the Figure, the ladle 17 is supported on a ladle car 14, which is configured to move the ladle from the LMF 10 along the factory floor 12 to a twin roll caster (not shown). The steel charge, or bath is heated within the ladle 17 by one or more electrodes 38. Electrode 38 is supported by a conducting arm 36 and an electrode column 39. Conducting arm 36 is supported by electrode column 39, which is movably disposed within support structure 37. Current conducting arm 36 supports and channels current to electrode 38 from a transformer (not shown). Electrode column 39 and regulating cylinder 44 are configured to move electrode 38 and conducting arm 36 up, down, or about the longitudinal axis of column 39. Regulating cylinder 44 is attached to support structure 37 and is configured with a telescoping shaft. In operation, as column 39 lowers, electrode 38 is lowered through an aperture (not shown) in furnace hood or exhaust 34 and an aperture (not shown) in furnace lid 32 into the ladle 17 and beneath the slag in order to heat the metal within the ladle 17. Hydraulic cylinder 33 moves lid 32 and hood 34 up and down from the raised position to the operative lowered position. Heat shield 41 protects the electrode support and regulating components from the heat generated by the furnace. While only one electrode 38 is shown, it will be appreciated that additional electrodes 38 may be provided for heating operations. Various furnace components, such as, for example, the lid 32, the lift cylinder 33, and the conducting arm 36, are water cooled. Other suitable coolants and cooling techniques may also be employed.

A stir lance 48 is movably mounted on lance support column 46 via support arm 47. Support arm 47 slides up and down column 46, and rotates about the longitudinal axis of column 46 so as to swing lance 48 over the ladle 17, and then lower the lance 48 down through apertures (not shown) in hood 34 and lid 32 for insertion into the ladle bath. The lance 48 and support arm 47 are shown in phantom in the raised position. An inert gas, such as, for example, argon or nitrogen is bubbled through stir lance 48 in order to stir or circulate the bath to achieve a homogeneous temperature and composition and to cause deoxidation and desulphurization of the steel. Alternatively, the same results may be achieved by bubbling the inert gas through a refractory plug (not shown), such as an isotropic porous or capillary plug, configured in the bottom of the ladle 17. Stirring may also be accomplished through electromagnetic stirring, or other alternative methods, in conjunction with injection of an inert gas.

The steel chemistry is such as to produce a slag regime rich in CaO. The injection of inert gas, such as for example argon or nitrogen, for stirring produces a very low free oxygen level with silicon deoxidation and consequent desulphurization to a very low sulphur level. The slag is then thickened by lime addition to prevent reversion of sulphur back into the steel and oxygen is injected into the steel, using for example a lance, to increase the free oxygen content to the order of between about 40 ppm and about 70 ppm and generally about 50 ppm so as to produce a steel that is readily castable in a twin roll caster. That steel is then delivered to a twin roll caster and cast into thin steel strip. The free oxygen in the molten steel may be measured by, for example, a Celox© oxygen measurement system as described in "On-Line Oxygen Measurements During Liquid Steel Processing Using Novel Electrochemical Sensors." By K. Carlier, Heraeus Electro-Nite International N.V., Entrum-Zuid 1105, 3530 Houthalen, Belgium (available from author). See also U.S. Pat. Nos. 4,342,633 and 4,964,736. The free oxygen is oxygen dissolved in the steel that is not combined with other elements in forming oxides. Compounds to be removed during refining will react with the free oxygen to form oxides, such as $SiO_2$, MnO, and FeO which will find their way to the slag.

The results from a trial of the illustrative method conducted in a ladle of 120 tons capacity in an LMF with argon gas injection through a submerged lance are set out in the following Table 1.

TABLE 1

| MELTING PROCEDURE | C | Mn | Si | S | O | T |
|---|---|---|---|---|---|---|
| Key steps summarized below: | | | | | | |
| 1. EAF Tap chemistry | 0.047 | 0.04 | 0.0 | 0.031 | 1041 | 1674 (3045) |
| Tap additions: 500 lb Fe—Si, 1600 lb hi Cal time, 500 lb spar | | | | | | |
| LMF additions: 1200 lb med carbon Fe—Mn, 20 lbs spar | | | | | | |
| After Argon Stir (Desulphurization) | | | | | | |
| 2. L1 (atLMF) | 0.046 | 0.46 | 0.095 | 0.032 | 102 | 1619 (2947) |
| 3. L2 (after 1st stirring-4 min) | 0.057 | 0.49 | 0.06 | 0.015 | 26.7 | 1624 (2955) |
| 200 lb Fe—Si + 250 lb Lime additions | | | | | | |
| 4. L3 (after 2nd stirring - 4 min) | 0.054 | 0.5 | 0.18 | 0.008 | 8 | 1604 (2902) |
| Slag Thickening | | | | | | |
| 1000 lb lime for to thicken slag | | | | | | |
| 5. L4 (after slag thickened) | 0.057 | 0.49 | 0.09 | 0.01 | 16.6 | 1626 (2958) |
| Oxy injection | | | | | | |
| 1st lance 1 min 30 s, 2nd lance 2 min 48 s | | | | | | |
| 6. L5 | 0.058 | 0.48 | 0.086 | 0.01 | 63.9 | 1608 (2926) |
| 7. L6 (after 16 min from L5) | 0.06 | 0.48 | 0.08 | 0.01 | 59.5 | 1599 (2911) |
| 8. L7 (after 20 min) | 0.06 | 0.48 | 0.078 | 0.01 | 50.3 | 1592 (2998) |
| 9. L8 (after 24 min) | 0.058 | 0.48 | 0.075 | 0.01 | 55 | 1614 (2938) |

| INCLUSION ANALYSIS | | | | | | |
|---|---|---|---|---|---|---|
| Sample no | CaO | MgO | $Al2O_3$ | $SiO_2$ | MnO | FeO |
| Before Oxygen Injection (after Ar stir) | | | | | | |
| L2 | 17.73 | 8.91 | 22.27 | 48.77 | 1.21 | 1.12 |
| L3 | 8.9 | 19.9 | 26.8 | 37.9 | 4.5 | 1.9 |
| L4 | 6.03 | 17.43 | 43.28 | 30.85 | 1.72 | 0.7 |
| After Oxygen Injection | | | | | | |
| L5 | 2.71 | 1.32 | 16.79 | 58.81 | 20.12 | 0.25 |
| L6 | 2.68 | 3.37 | 22.19 | 54.0 | 17.70 | 0.06 |
| L7 | 1.7 | 3.8 | 31.3 | 40.6 | 21.1 | 1.5 |

It will be seen from the results in Table 1 that the sulphur level was initially reduced to 0.008% prior to the addition of 1000 lb lime to thicken the slag for slag separation, but a slight reversion to 0.01% occurred during the slag thickening process.

As mentioned above, when twin roll casting plain carbon steel directly into thin strip, it is possible to employ silicon/manganese killed steel having a sulphur content of less than 0.01% by weight. It will be seen from the above test results that this can be readily achieved by the method of the present invention. Casting may then be carried out in a twin roll caster of the kind fully described in U.S. Pat. Nos. 5,184,668 and 5,277,243 to produce a strip of less than 5 mm thickness, for example of the order of 1 mm thickness or less.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method of refining steel in a ladle, including heating a steel charge and slag forming material in a ladle to form molten steel covered by a slag containing silicon, manganese and calcium oxides, wherein the molten steel has a carbon content in the range 0.001% to 0.1% by weight, a manganese content in the range of 0.1% to 2.0% by weight and a silicon content in the range 0.1% to 10% by weight, and stirring the molten steel by injecting an inert gas into it to cause silicon/manganese deoxidation and desulphuization of the steel to produce a silicon/manganese killed molten steel having a sulphur content of less than 0.01% by weight.

2. The method as claimed in claim 1 wherein the molten has a free oxygen content of no more than 20 ppm during the desulphurization.

3. The method as claimed in claim 2, wherein the free oxygen content during desulphurization is about 12 ppm or less.

4. The method as claimed in claim 1 wherein the inert gas is argon.

5. The method as claimed in claim 2, wherein the inert gas is argon.

6. The method as claimed in claim 3, wherein the inert gas is argon.

7. The method as claimed in claim 1 wherein the inert gas is nitrogen.

8. The method as claimed in claim 2, wherein the inert gas is nitrogen.

9. The method as claimed in claim 3, wherein the inert gas is nitrogen.

10. The method as claimed in claim 1 wherein the inert gas is injected into a bottom part of the molten steel in the ladle at a rate of between 0.35 scf/min to 1.5 scf/min per ton of steel in the ladle so as to produce a strong stirring action promoting effective contact between the molten steel and the slag.

11. The method as claimed in claim 1 wherein at least part of the inert gas is injected into the molten steel through an injector in the floor of the ladle.

12. The method as claimed in claim 1 wherein at least part of the inert gas is injected into the molten steel through at least one injection lance extended downwardly into the bottom part of the metal in the ladle.

13. The method as claimed in claim 1 wherein the steel has an aluminum content of about 0.01% or less by weight.

14. The method as claimed in claim 13, wherein the aluminum content is 0.008% or less by weight.

15. The method as claimed in claim 1 wherein the sulphur content of the desulphurized steel is less than 0.009% by weight.

16. A method of refining steel in a ladle, including heating a steel charge and slag forming material in a ladle to form molten steel covered by a slag containing silicon, manganese and calcium oxides, and stirring the molten steel by injecting an inert gas into it to cause silicon/manganese deoxidation and desulphuization of the steel to produce a silicon/manganese killed molten steel having a sulphur content of less than 0.01% by weight, wherein at the conclusion of desulphurization, the slag is thickened to prevent reversion of sulphur into the steel and oxygen is injected into the steel to increase the free oxygen content thereof.

17. The method as claimed in claim 16, wherein the slag is thickened by the addition of lime thereto.

18. The method as claimed in claim 16, wherein the oxygen injection increases the free oxy(,en content of the steel to between about 40 ppm and about 70 ppm.

19. The method as claimed in claim 17, wherein the oxygen injection increases the free oxygen content of the steel to between about 40 ppm and about 70 ppm.

* * * * *